United States Patent [19]

Fueki et al.

[11] 3,939,056

[45] Feb. 17, 1976

[54] COATED PLATING RACK

[75] Inventors: Shimetomo Fueki, Tokyo; Shigeo Ohuchi; Kazuhiro Ogawa, both of Yokohama, all of Japan

[73] Assignee: Sony Corporation, Tokyo, Japan

[22] Filed: Oct. 19, 1973

[21] Appl. No.: 408,179

[52] U.S. Cl. ..... 204/297 W; 204/297 R; 260/75 S

[51] Int. Cl.[2] ..... C25D 17/08

[58] Field of Search ..... 204/297 R, 297 W

[56] References Cited

UNITED STATES PATENTS

| | | | |
|---|---|---|---|
| 2,727,879 | 12/1955 | Vincent | 260/45.7 S |
| 3,272,733 | 9/1966 | Belke | 204/297 W |
| 3,484,361 | 12/1969 | Sperry | 204/297 W |
| 3,619,243 | 11/1971 | Brindisi et al. | 117/47 W |
| 3,671,416 | 6/1972 | Belke | 204/297 W |
| 3,728,232 | 4/1973 | Morita et al. | 204/30 |
| 3,790,517 | 2/1974 | Koizumi et al. | 260/45.7 S |

*Primary Examiner*—F. C. Edmundson

*Attorney, Agent, or Firm*—Lewis H. Eslinger; Alvin Sinderbrand

[57] ABSTRACT

A rack for supporting electrically non-conductive articles during the successive chemical or electroless plating and electroplating of such articles has its metal frame covered with a plastic resin coating in which there is dispersed one or more organosulphur compounds so that plating material will not adhere to the rack during the chemical or electroless plating of articles supported thereby nor during the subsequent further electroplating of such articles.

2 Claims, 2 Drawing Figures

COATED PLATING RACK

BACKGROUND OF THE INVENTION

1. Field of the Invention

This invention relates generally to racks for supporting articles during the plating thereof, and more particularly is directed to a coating for such racks intended to be used for supporting electrically non-conductive articles during the chemical or electroless plating thereof and also, if desired, during a subsequent further electroplating of the supported articles.

2. Description of the Prior Art

When an article of an electrically non-conductive material, for example, a plastic resin, glass, porcelain, ceramic or the like, is to be plated, such article is supported or suspended from a rack and, while thus suspended, is subjected to an electroless or chemical plating process for depositing a metal layer on the surface of the article, whereupon, if desired, the article may be subjected to a further electroplating process for depositing an additional metal layer thereon from an electrolyte. The racks used for supporting articles during the electroplating thereof are usually formed of metal, such as, copper, stainless steel or the like, covered with a resin paint coating, for example, of polyvinyl chloride, polyethylene, polyester, polyurethane or the like, so that the plating metal will not be deposited on the rack itself during the electroplating process. However, if such racks are used for supporting non-conductive articles during the chemical or electroless plating thereof, as aforesaid, the coated surface of the rack is activated during the activating treatment to which the suspended non-conductive articles are subjected as a prelude to the chemical or electroless plating process. Therefore, the electroless plating process deposits metal on the coated surface of the rack as well as on the non-conductive article or articles suspended therefrom. If the electroless plating process is followed by an electroplating process to further plate the non-conductive articles while suspended from the same rack, then the surface of the rack is also electroplated.

It will be apparent that the deposit of plating materials on the rack during the electroless plating of non-conductive articles suspended therefrom and during the subsequent electroplating of such articles constitutes a waste of such plating materials. Further, if the coated rack supporting the non-conductive articles during the electroplating thereof has had its surface plated with metal during the preceding electroless plating process, such metal plating on the rack causes non-uniform current distribution which results in deterioration of the electroplating of the suspended articles, particularly at concave portions of the latter.

In view of the foregoing, it has been the practice in plating non-conductive articles to manually transfer the latter from the rack supporting the same during the initial electroless plating to another coated rack whose surface is not plated with metal and from which the articles are then suspended during the subsequent electroplating process. However, it is obvious that a substantial waste of labor is involved in manually transferring the articles from one rack to another intermediate the electroless and electroplating processes. Further, the need to transfer the articles from one rack to another makes it impossible to carry out the entire plating operation by means of a fully automated or conveyor system.

With the foregoing arrangement, the racks used during the electroless plating of the non-conductive articles usually have the deposited metal removed therefrom by means of nitric acid. However when the deposited metal is thus dissolved, gaseous nitrogen oxides, such as, nitrogen monoxide and dioxide, are generated and these nitrogen oxides are toxic to humans and must be specially treated.

In order to avoid the foregoing problems, it has been proposed to provide racks used for supporting non-conductive articles during the plating thereof with a plastic resin coating which contains one or more metal oxides, for example, oxides of cadmium, antimony, lead or the like, and/or to treat such racks with a liquid or gaseous halide prior to the electroless plating process so as to avoid deposition of metal on the rack surface during such plating process. However, such metal oxides are generally insoluble in organic solvents, so that it is difficult to uniformly disperse the metal oxide in the plastic coating material for reliably ensuring that metal will not be deposited on the coated surface of the rack during the electroless plating of articles suspended therefrom. Further, the described gaseous halides are very toxic to humans so that the treatment of racks therewith requires the use of expensive exhaust and treating devices.

SUMMARY OF THE INVENTION

Accordingly, it is an object of this invention to provide a rack for supporting non-conductive articles during the plating of the latter and which avoids the above described disadvantages of racks previously used for that purpose.

More specifically, it is an object of this invention to provide a coating for a rack, as foresaid, which reliably avoids the deposition of metal or plating material on the rack during electroless plating of non-conductive articles suspended therefrom and during subsequent electroplating of such articles while suspended from the same rack.

In general, in accordance with this invention, a rack for supporting non-conductive articles during the plating thereof is coated with a plastic resin material, such as polyvinyl chloride, polyethylene, polyester, polyurethane and the like, in which there is uniformly dispersed one or more organosulphur compounds. The amount of the organosulphur compound included in the coating material is preferably in the range between approximately 1.5 to 200 grams per kilogram of the plastic resin. If substantially less than 1.5 grams of organosulphur compound is used per kilogram of the resin in the coating material, then plating material is deposited on the rack during electroless plating of articles suspended therefrom. If the amount of organosulphur compound exceeds 200 grams per kilogram of resin in the coating material, then the resin will not harden satisfactorily when applied to the rack.

Figure 1:
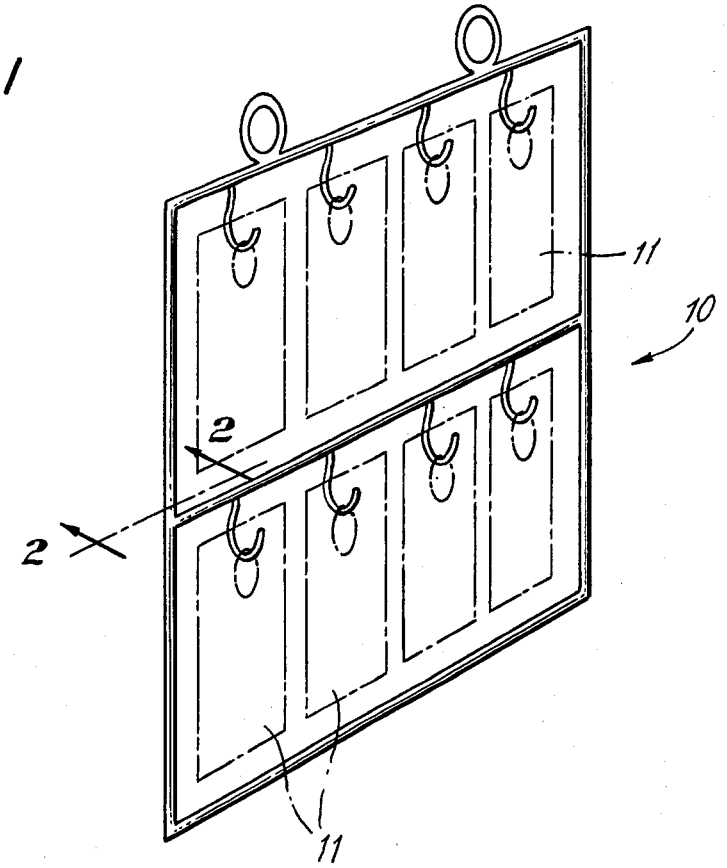
FIG. 1 is a perspective view illustrating a rack according to this invention for supporting non-conductive articles during the successive electroless plating and electroplating of such articles which are shown in broken lines.
Figure 2:
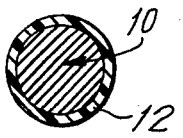
FIG. 2 is an enlarged sectional view taken along the line 2—2 on FIG. 1.

Referring to the drawing in detail, it will be seen that the reference numeral 10 generally identifies a rack for supporting non-conducting articles 11 during the successive electroless plating and electroplating of such articles. In accordance with this invention, and as shown particularly on FIG. 2, all portions of the rack 10 are fully covered with a coating or layer 12 of a plastic resin material having one or more organosulphur compounds uniformly dispersed therein.

The rack 10 itself may be formed of any suitable metal, such as, copper, stainless steel or the like, and may be given any desired configuration for suspending articles therefrom.

Among the organosulphur compounds that can be used in the rack coating are the following:

Thiophenol; Trichlorobenzenethiol; Pentachlorobenzenethiol; Naphthalenethiol; Anthracenethiol; Xylenethiol; 2-Thiohydantoin; 1-Acetyl-5,5-dimethyl-2-thiohydantoin; 5,5-Dimethyl-2-thiohydantoin; 2-Mercaptobenzimidazole; 2-Mercaptobenzthiazole; 2,4-Dimercapto[1,2,4]-triazolo-[5,4-b][1,3,4]-thiadizole; 5-Imino-3-mercapto-1,2,4-triazole; 5-Hydroxy-3-mercapto-1,2,4-triazole; 4-Methyl-5-methylimino-3-mercapto-1,2,4-triazole; 4-Ethyl-5-ethylimino-3-mercapto-1,2,4-triazole; 4-Methyl-3,5-dimercapto-1,2,4-triazole; 4-Ethyl-3,5-dimercapto-1,2,4-triazole; 4-Amino-3,5-dimercapto-1,2,4-triazole; 4-Phenyl-3,5-dimercapto-1,2,4-triazole; 2-Thiobarbituric acid; Dithioammelide; Hydrazinocarbothioamide; Hydrazinocarbothiomethylamide; Hydrazinocarbonethioethylamide; Hydrazinocarbonethiophenylamide; 5,6-Dihydro-4-phenyl-2-mercapto-1,3,4-thiadiazine; 4,6-Diamino-2-mercapto-1,3,5-thiadiazine; Ethylenebisdithiocarbamic acid; Ethylenethiuram-monosulfide; Dihydrazinothiuram-monosulfide; Dihydrazinothiuram-disulfide; and Dinaphthyl-disulfide.

SPECIFIC EXAMPLES OF THE INVENTION

EXAMPLE I

4-Phenyl-3,5-dimercapto-1,2,4-triazole is intimately mixed into a polyvinyl chloride paint in an amount equivalent to 3 grams thereof per kilogram of polyvinyl chloride. The resulting mixture is applied to a rack of copper alloy so as to fully coat or cover the rack, as by dipping or immersing the rack in the coating mixture, whereupon the coated rack is heated to a temperature of 140°C for 30 minutes so as to harden the coating thereon.

The resulting coated rack is then employed to support a non-conductive body or article of ABS copolymer, that is, a copolymer of styrene-acrylonitrile with butadiene-acrylonitrile, during the plating of such article. As a preliminary to the chemical or electroless plating of the article suspended from the coated rack, such article is subjected to a conventional cleaning or grease removing treatment, followed by successive etching, sensitizing and activating treatments. The etching treatment is accomplished with an etchant consisting of chromic-anhydride and sulfuric acid. The sensitizing treatment involves immersing the etched article and the rack from which it is suspended in an aqueous solution containing 20 grams per liter of tin chloride and 22 c.c. per liter of hydrochloric acid, and the activating treatment involves immersing the suspended article in an aqueous solution containing 0.12 grams per liter of palladium chloride and having a pH of 3.0.

After such preliminary treatments, the rack and the non-conductive article suspended therefrom are subjected to a chemical or electroless nickel plating process by being immersed in an aqueous nickel plating solution containing 20 grams per liter of nickel sulfate, 27 grams per liter of sodium hypophosphite and 16 grams per liter of sodium succinate, and which is maintained at a temperature of 55°C. and a pH of 5.5. The article is maintained in the electroless nickel plating solution for a period of time sufficient to provide a desired thickness of nickel plating the article. Upon the removal of the rack and the article suspended therefrom from the nickel plating solution, it is found that the non-conductive article is plated with nickel, but that the rack itself is not coated or plated with nickel. Thereafter, the non-conductive article, while still suspended from the same rack, is subjected to a conventional nickel electroplating process to further nickel plate the non-conductive article, and no nickel is deposited on the coated rack during such electroplating process.

The same coated rack is used to support non-conductive articles, as aforesaid, during 100 repetitions of the cycle of successive electroless and electroplating processes and it is found that no nickel is deposited on the coated rack at the conclusion thereof.

EXAMPLE II

Dinaphthyl-disulfide is intimately mixed into a polyvinyl chloride paint in an amount equivalent to 2 grams thereof per kilogram of polyvinyl chloride, and the resulting mixture is applied as a coating to a copper alloy rack, as in Example I. A non-conductive article of ABS copolymer is then suspended from the coated rack while being subjected to successive grease removing, etching, sensitizing and activating treatments followed by succesive electroless and plating processes for nickel plating the suspended article, all as specified in Example I. It is found that nickel is deposited only on the article and not on the coated rack either during the chemical or electroless plating process or during the subsequent electroplating process. Further, no nickel is deposited on the coated rack even when the latter is used to support articles during one hundred repetitions of the plating processes.

EXAMPLE III

The procedures recited in Examples I and II are repeated, but with a copper alloy rack coated with polyvinyl chloride paint containing 50 grams of Xylenethiol per kilogram of vinyl chloride. Once again, the thus coated rack is not plated with nickel either during the electroless or chemical plating of the non-conductive articles suspended therefrom or during the subsequent electroplating of the suspended articles, and there is no build-up of nickel on the coated rack even when the latter is used for one hundred repetitions of the plating operations.

EXAMPLE IV

Pentachlorobenzenethiol is intimately mixed into a polyethylene paint in an amount equivalent to 10 grams thereof per liter of the polyethylene paint, and the resulting mixture is applied as a coating to a copper rack, as in Example I. A ceramic article is then suspended from the coated rack while being subjected to successive grease removing, etching, sensitizing and activating treatments, as specified in Example I. Thereafter, the suspended article is immersed in a chemical or electroless aqueous copper plating solution which contains 7 grams per liter of cupric sulfate, 2 grams per liter of nickel chloride, 2 grams per liter of sodium carbonate, 22 grams per liter of rochelle salt, 25 c.c. per liter of formaldehyde and 5 grams per liter of sodium hydroxide, and which is maintained at a temperature of 25°C. and a pH of 12.7. Upon removal from such copper plating solution, it is found that electroless copper plating is applied only to the surface of the ceramic article and not at all to the coated rack. Subsequently, the ceramic article, while suspended from the same rack, is subjected to a conventional copper electroplating process to further copper plate the surface of the ceramic article, and no copper is deposited on the rack itself during such electroplating process.

The same coated rack is used to support ceramic articles, as aforesaid, during 150 repetitions of the above described cycle of electroless and electroplating processes and it is found that no copper is deposited on the coated rack at the conclusion thereof.

Reference Example

The procedures specified in Example I are repeated but with the coating on the rack consisting only of the polyvinyl chloride paint, that is, the 4-Phenyl-3,5-dimercapto-1,2,4-triazole is omitted from the coating. It is found that nickel is deposited on the coated rack, as well as on the article of ABS copolymer suspended therefrom, both during the chemical electroless plating process and during the subsequent electroplating process. Therefore, before each reuse of the rack, the nickel deposited thereon has to be removed by means of nitric oxide in order to prevent the buildup of the plating metal on the repeatedly used rack. However, as previously noted, such removal of plating metal from the rack before each reuse represents an additional costly step in the plating process, and requires special equipment for treating the noxious or toxic nitrogen oxides that result. Further, the removed plating metal represents a costly waste thereof.

It will be apparent that racks coated according to this invention, as in Examples I–IV above, can be used to support articles during the successive chemical and electroplating processes without the deposit of plating metal on the rack itself, and thus can be reused, at least several hundred times, without the expense and trouble of removing metal from the rack after each plating cycle. Further, since no plating metal is deposited on the rack, the waste of plating material is avoided.

Although specific examples of the invention have been described in detail above, it will be understood that the invention is not limited to those precise examples which may be modified by one skilled in the art without departing from the scope or spirit of the invention as defined in the appended claims.

What is claimed is:

1. A rack for supporting electrically non-conductive articles during the successive electroless plating and electroplating of such articles, said rack comprising a metal frame, and a plastic resin coating on said frame, said resin selected from the group consisting of polyvinyl chloride, polyethylene, polyester and polyurethane, said plastic resin coating having substantially uniformly dispersed therein at least one organosulphur compound which is present in said coating in an amount between approximately 1.5 and 200 grams of said organosulphur compound per kilogram of said resin.

2. A rack according to claim 1; in which said organosulphur compound is selected from the group consisting of Thiophenol; Trichlorobenzenethiol; Pentachlorobenzenethiol; Naphthalenethiol; Anthracenethiol; Xylenethiol; 2-Thiohydantoin; 1-Acetyl-5,5-dimethyl-2-thiohydantoin; 5,5-Dimethyl-2-thiohydantoin; 2-Mercaptobenzimidazole; 2-Mercaptobenzthiazole; 2,4-Dimercapto-1,2,4-triazolo-[5,4-b][1,3,4]-thiadiazole; 5-Imino-3-mercapto-1,2,4-triazole; 5-Hydroxy-3-mercapto-1,2,4-triazole; 4-Methyl-5-methylimino-3-mercapto-1,2,4-triazole; 4-Ethul-5-ethylimino-3-mercapto-1,2,4-triazole; 4-Methyl-3,5-dimercapto-1,2,4-triazole; 4-Ethyl-3,5-dimercapto-1,2,4-triazole; 4-Amino-3,5-dimercapto-1,2,4-triazole; 4-Phenyl-3,5-dimercapto-1,2,4-triazole; 2-Thiobarbituric acid; Dithioammelide; Hydrazinecarbothioamide; Hydrazinocarbothiomethylamide; Hydrazinocarbothioethylamide; Hydrazinocarbothiophenylamide; 5,6-Dihydro-4-phenyl-2-mercapto-1,3,4-thiadiazine; 4,6-Diamino-2-mercapto-1,3,5-; thiadiazole Ethylenebisdithiocarbamic acid; Ethylenethiuram-monosulfide; Dihydrazinothiuram-monosulfide; Dihydrazinothiuramdisulfide; and Dinaphthyl-disulfide.

* * * * *